US007997938B2

(12) United States Patent
Costello et al.

(10) Patent No.: US 7,997,938 B2
(45) Date of Patent: Aug. 16, 2011

(54) ELECTRICAL CONNECTOR SYSTEM WITH ELECTRICAL POWER CONNECTION AND GUIDE FEATURES

(75) Inventors: Brian Patrick Costello, Scotts Valley, CA (US); Jordan Marshall Cole, San Jose, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/604,169

(22) Filed: Oct. 22, 2009

(65) Prior Publication Data

US 2011/0097945 A1 Apr. 28, 2011

(51) Int. Cl.
*H01R 24/00* (2011.01)

(52) U.S. Cl. ..... 439/660

(58) Field of Classification Search ..... 439/79, 439/101, 108, 247, 248, 660, 680, 681
See application file for complete search history.

(56) References Cited

U.S. PATENT DOCUMENTS 4,179,179 A * 12/1979 Lowden ..... 439/278
4,580,868 A * 4/1986 Verstijnen ..... 439/680
5,356,300 A 10/1994 Costello et al.
5,816,842 A * 10/1998 Thantrakul et al. ..... 439/374
5,876,248 A * 3/1999 Brunker et al. ..... 439/607.08
5,885,088 A * 3/1999 Brennan et al. ..... 439/680
6,129,591 A * 10/2000 Czeschka ..... 439/680
6,383,032 B1 * 5/2002 Gerberding ..... 439/681
6,733,302 B1 * 5/2004 Smalley et al. ..... 439/65
7,065,871 B2 * 6/2006 Minich et al. ..... 29/882
7,247,058 B2 7/2007 Reeser et al.
7,686,659 B2 * 3/2010 Peng ..... 439/680
7,690,937 B2 * 4/2010 Daily et al. ..... 439/290
7,726,982 B2 * 6/2010 Ngo ..... 439/79
7,762,857 B2 * 7/2010 Ngo et al. ..... 439/856

* cited by examiner

*Primary Examiner* — Thanh-Tam T Le

(57) ABSTRACT

An electrical connector for mating with a mating connector includes a housing having a mating face and a guide member. The guide member includes a receptacle and a guide wall. The guide wall includes an interior surface that at least partially defines the receptacle. The interior surface includes a guide feature. The receptacle is configured to receive a plug of a mating housing of the mating connector therein. An electrical power contact includes a mating end held within the receptacle of the guide member. The guide wall of the guide member extends at least partially around the mating end of the electrical power contact.

18 Claims, 11 Drawing Sheets

ELECTRICAL CONNECTOR SYSTEM WITH ELECTRICAL POWER CONNECTION AND GUIDE FEATURES

BACKGROUND OF THE INVENTION

The subject matter herein relates generally to electrical connectors, and more particularly to electrical connector systems having electrical power connections and guide features.

Electrical connectors are commonly used to interconnect electrical components together. For example, electrical connectors are sometimes used to electrically connect two circuit boards together. To interconnect the electrical components, an electrical connector of one of the electrical components is mated with an electrical connector of the other electrical component along mating interfaces of the connectors. As the electrical connectors are mated together, signal, power, and/or ground contacts that extend along the mating interfaces engage each other to electrically connect the connectors, and thereby the electrical components, together.

Some electrical connectors include guide members for aligning the mating interfaces of the connectors. Specifically, as the electrical connectors are mated together, guide members on each of the connectors cooperate to align the corresponding contacts of the electrical connectors with each other. For example, electrical connectors where the contacts and/or the mating interfaces are not visible during mating, sometimes referred to as blind-mate connectors, often include guide members. Guide members typically include posts or similar structures that extend outwardly from a housing of one of the electrical connectors. The posts are received within corresponding openings within the housing of the other electrical connector to ensure the connectors are properly aligned.

In known electrical connectors, the guide features are spaced apart along the housing from the mating interface and the contacts that extend along the mating interface. Accordingly, the housing must include extra space for accommodating the guide members. Due to the ever increasing demand for smaller and denser electrical connections, it may be difficult to provide some electrical connectors with guide members. For example, it may be difficult or impossible to increase a number and/or density of electrical connections on a circuit board while still providing electrical connectors mounted on the circuit board with guide members. Providing extra space for the guide members on the housing may be especially problematic for electrical connectors that have separate mating interfaces for signal contacts and power contacts.

BRIEF DESCRIPTION OF THE INVENTION

In one embodiment, an electrical connector for mating with a mating connector includes a housing having a mating face and a guide member. The guide member includes a receptacle and a guide wall. The guide wall includes an interior surface that at least partially defines the receptacle. The interior surface includes a guide feature. The receptacle is configured to receive a plug of a mating housing of the mating connector therein. An electrical power contact includes a mating end held within the receptacle of the guide member. The guide wall of the guide member extends at least partially around the mating end of the electrical power contact.

In another embodiment, an electrical connector for mating with a mating connector includes a housing having a mating interface and a guide member. The guide member includes a plug configured to be received by a mating housing of the mating connector. The guide member includes an exterior surface that at least partially defines the plug. The exterior surface includes a guide feature. The guide member includes an individual contact channels extending therein. An electrical power contact is held by the housing. The electrical power contact includes mating ends that extend within corresponding ones of the individual contact channels of the guide member for engagement with corresponding contacts of the mating connector.

DETAILED DESCRIPTION OF THE INVENTION

Figure 1:
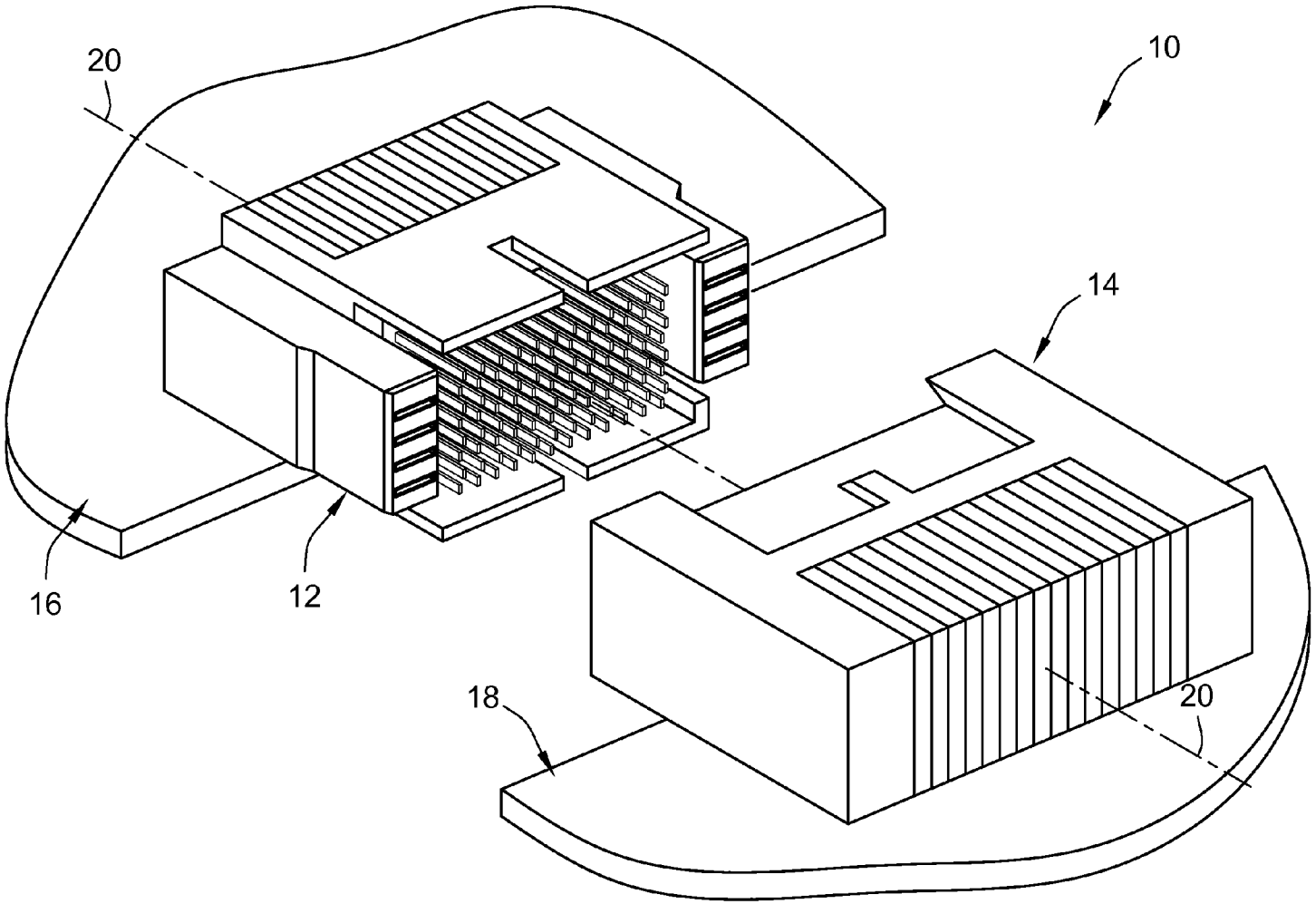
FIG. 1 is a perspective view of an exemplary embodiment of an electrical connector system illustrating a receptacle connector and a header connector of the system as unmated.

FIG. 1 is a perspective view of an exemplary embodiment of an electrical connector system 10 illustrating a header connector 12 and a receptacle connector 14 that may be directly connected, or mated, together. The electrical connector system 10 includes the header connector 12 and the receptacle connector 14, which are each directly connected to, and mounted on, a respective circuit board 16 and 18. A mating axis 20 extends through both the header connector 12 and the receptacle connector 14. The connectors 12 and 14 can be mated together in a direction parallel to and along the mating axis 20 for transferring electrical power, electrical signals, and/or electrical ground between the circuit boards 16 and 18. The header connector 12 and the receptacle connector 14 may each be referred to herein as an "electrical connector" and/or as a "mating connector".

Figure 2:
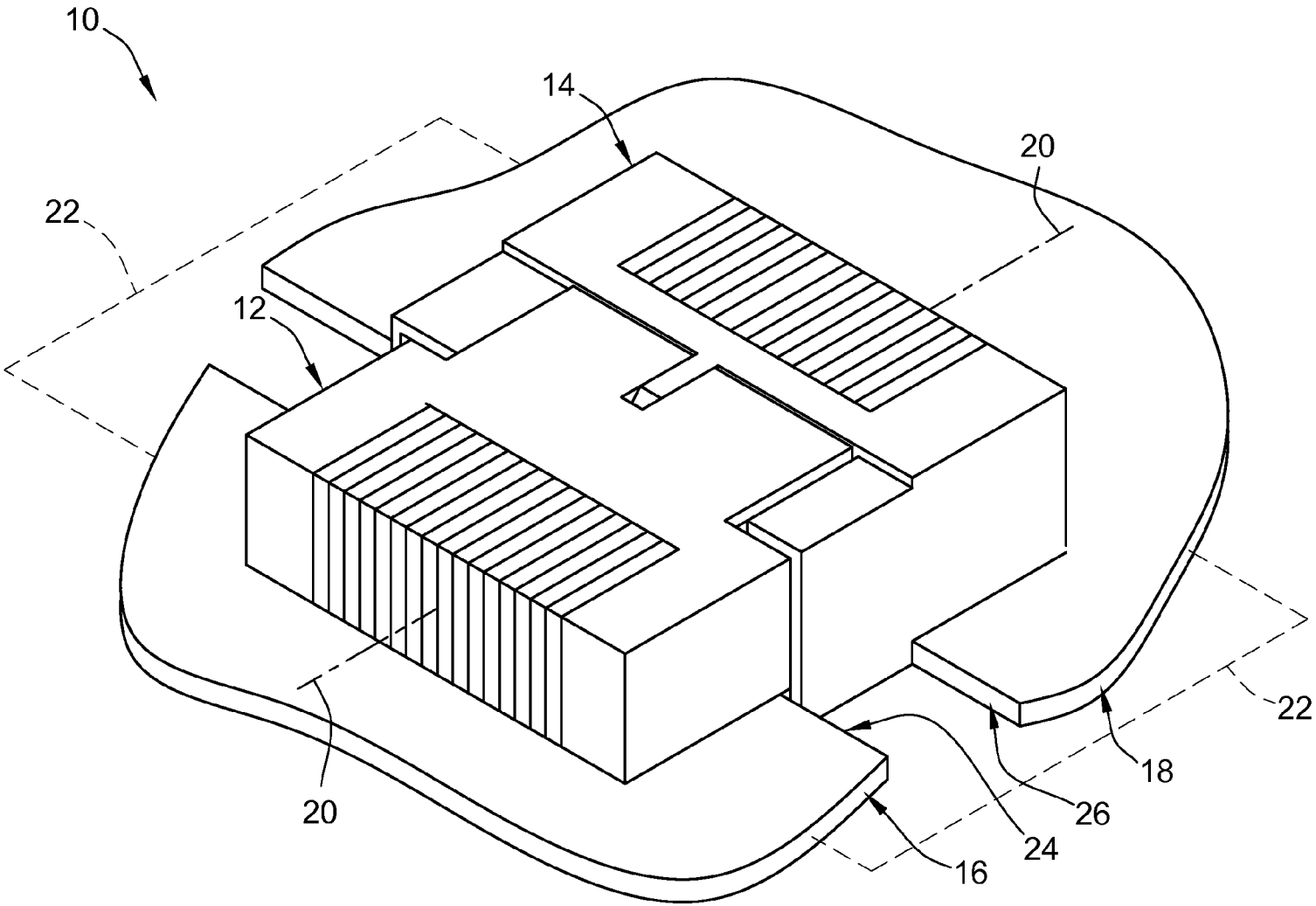
FIG. 2 is a perspective view of the electrical connector system shown in FIG. 1 illustrating the receptacle connector and the header connector mated together.

FIG. 2 is a perspective view of the electrical connector system 10 illustrating the header connector 12 and the receptacle connector 14 mated together. During mating, at least one of the header connector 12 and the receptacle connector 14 are moved towards the other along the mating axis 20 until the connectors 12 and 14 are mated with one another. When mated, an electrical connection is established between the header connector 12 and the receptacle connector 14. An electrical connection is thereby established between the circuit boards 16 and 18 via the connectors 12 and 14. When mated, both electrical power and data signals may be transmitted across the interface between the header connector 12 and the receptacle connector 14. Optionally, electrical ground is also transmitted across the interface between the header connector 12 and the receptacle connector 14. Electrical power may be supplied to the circuit board 16 and/or the circuit board 18 from an external source. The electrical power is transferred between the circuit boards 16 and 18 by the connectors 12 and 14. Optionally, either the header connector 12 or the receptacle connector 14 may be in a fixed position and only the other of the header connector 12 and the receptacle connector 14 is moved along the mating axis 20 to mate the connectors 12 and 14 together. For example, the header connector 12 may be fixed within an electronic device (not shown) such as, but not limited to, a host device, a computer, a network switch, a computer server, and/or the like, while the receptacle connector 14 may be part of an external device (not shown) being electrically connected to the electronic device, or vice versa.

In the exemplary embodiment, the circuit boards 16 and 18 extend coplanar to each other when the connectors 12 and 14 are mated together. In other words, the circuit boards 16 and 18 extend approximately parallel to each other in generally the same plane 22, such that respective edges 24 and 26 of the circuit boards 16 and 18 face each other. Alternatively, the circuit boards 16 and 18 have any other orientation, location, position, and/or the like relative to each other when the connectors 12 and 14 are mated together. For example, in some alternative embodiments, the circuit boards 16 and 18 extend orthogonally to each other when the connectors 12 and 14 are mated together. Moreover, and for example, in some alternative embodiments the circuit boards 16 and 18 extend parallel to each other in different planes when the connectors 12 and 14 are mated together.

Figure 3:
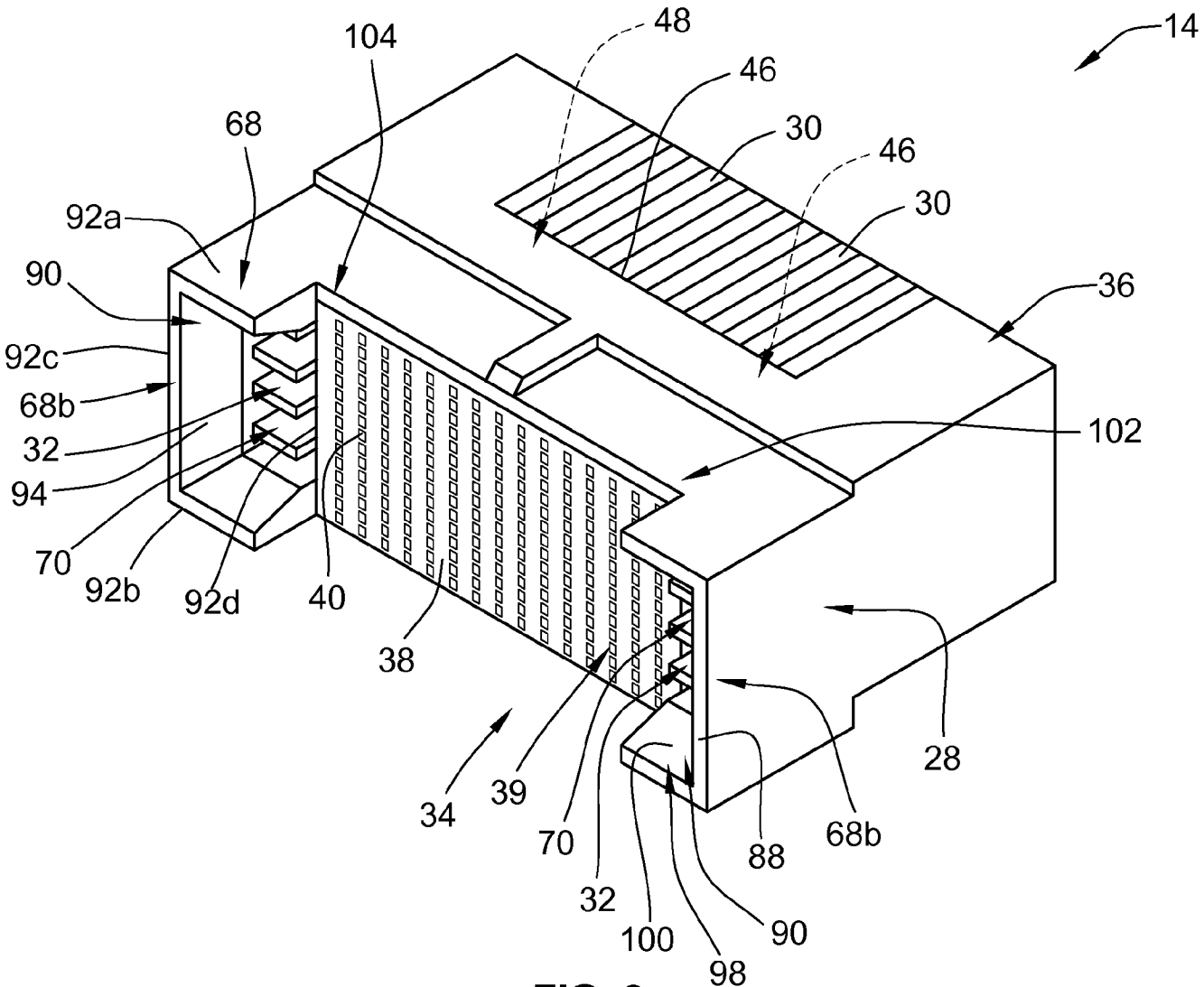
FIG. 3 is a perspective view of an exemplary embodiment of the receptacle connector of the electrical connector system shown in FIGS. 1 and 2.

FIG. 3 is a perspective view of the receptacle connector 14. The receptacle connector 14 includes a housing 28, a plurality of contact modules 30 held by the housing 28, and a plurality of electrical power contacts 32 held by the housing 28. The housing 28 extends from a front end 34 to a rear end 36. The front end 34 of the housing 28 includes a mating face 38. A plurality of contact channels 40 extend through the mating face 38 of the housing 28. Each contact channel 40 receives a corresponding mating contact 42 (FIG. 4) of a corresponding one of the contact modules 30 therein. The mating face 38 of the housing 28 thereby defines a signal contact area 39 having the mating contacts 42 held therein. The contact channels 40 are arranged in a pattern that complements a pattern of mating contacts 44 (FIG. 8) of the header connector 12 (FIGS. 1, 2, 8, 10, and 11). The contact modules 30 are received in the housing 28 from the rear end 36 of the housing 28. Specifically, the housing 28 defines a chamber 46 that receives a forward end 48 of each of the contact modules 30. While sixteen contact modules 30 are shown, the receptacle connector 14 may include any number of the contact modules 30. One or more of the mating contacts 42 may be referred to herein as an "electrical signal contact". The housing 28 may be referred to herein as a "mating housing".

Figure 4:
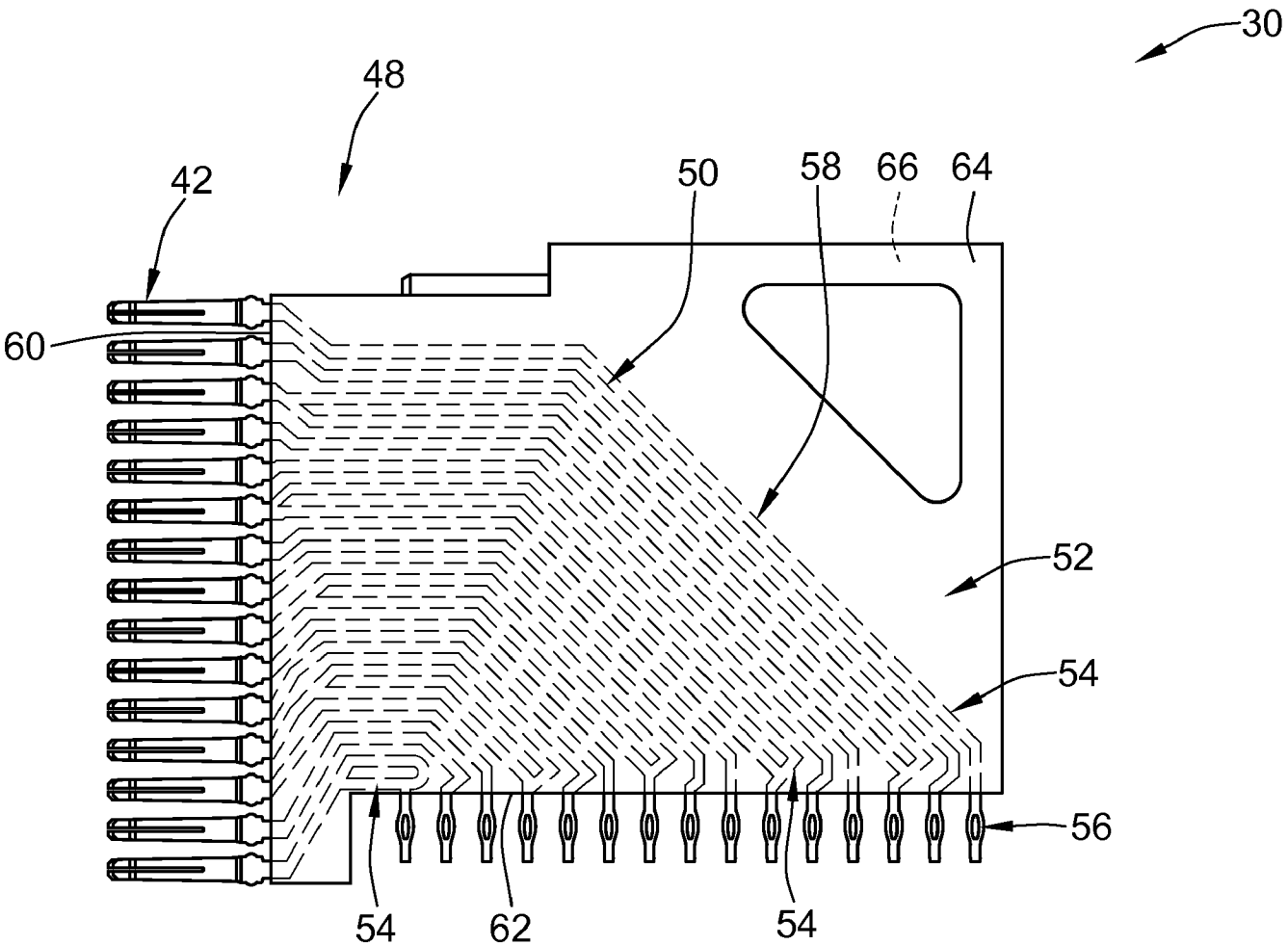
FIG. 4 is a side elevational view of an exemplary embodiment of a contact module of the receptacle connector shown in FIG. 3.

FIG. 4 is a side elevational view of an exemplary embodiment of one of the contact modules 30. The contact module 30 includes a lead frame 50 and a body 52. The lead frame 50 includes a plurality of leads 54 that each includes one or more of the mating contacts 42 and one or more mounting contacts 56. Each lead 54 also includes an intermediate lead segment 58 that extends along a predetermined path to electrically connect the corresponding mating contact(s) 42 to the corresponding mounting contact(s) 56. The intermediate lead segments 58 of the lead frame 50 are encased by the body 52. The mating contacts 42 extend from a mating edge 60 of the body 52, and the mounting contacts 56 extend from a mounting edge 62 of the body 52. When the contact module 30 is held by the housing 28 (FIGS. 3, 6, and 7) of the receptacle connector 14 (FIGS. 1-3, 6, and 7), each mating contact 42 extends within the corresponding contact channel 40 (FIG. 3) of the housing 28 of the receptacle connector 14. Each mating contact 42 is configured to be engaged with, and thereby electrically connected to, a corresponding mating contact 44 (FIG. 8) of the header connector 12 (FIGS. 1, 2, 8, 10, and 11) when the connectors 12 and 14 are mated together. Each mounting contact 56 is configured to be engaged with, and thereby electrically connected to, the circuit board 18.

The forward end 48 of the contact module 30 includes the mating edge 60 of the body 52. As will be described below, the mounting edge 62 of the body 52 defines a portion of a mounting face 63 (FIG. 6) of the receptacle connector 14. The body 52 includes opposite side portions 64 and 66 that extend approximately parallel to and along the lead frame 50. When the contact module 30 is held by the housing 28, the side portions 64 and 66 may each face an adjacent contact module 30 that is held by the housing 28. In the exemplary embodiment, the mating and mounting edges 60 and 62, respectively, extend substantially perpendicular to each other. However, the mating and mounting edges 60 and 62, respectively, may extend any direction relative to each other, such as, but not limited to, approximately parallel.

Each of the leads 54 of the contact module 30 may transmit electrical signals or electrical ground. The contact module 30 may include any number of leads 54, any number of which may be selected as electrical signal leads and electrical ground leads according the desired wiring pattern of the contact module 30. Optionally, adjacent electrical signal leads may function as differential pairs, and each differential pair may optionally be separated by an electrical ground lead. Similarly, each of the mating contacts 42 and each of the mounting contacts 56 may transmit electrical signals or electrical ground. The contact module 30 may include any number of mating contacts 42 and any number of mounting contacts 56. Any number of the mating contacts 42 and any number of the mounting contacts 56 may be selected as electrical signal contacts and electrical ground contacts according the desired wiring pattern of the contact module 30. Optionally, some mating contacts 42 function as differential pairs and some mounting contacts 56 may function as differential pairs. Each differential pair is optionally be separated by an electrical ground contact.

Each mating contact 42 may include any type of contact portion and may include any shape, such as, but not limited to, a receptacle contact portion, a forked contact portion, a spring contact portion, a non-planar shape, an eye-of-the needle shape, a pin, and/or the like. In the exemplary embodiment, the mounting contacts 56 include eye-of-the needle contact portions. However, each mounting contact 56 may include any type of contact portion and may include any shape, such as, but not limited to, a receptacle contact portion, a forked contact portion, a spring contact portion, a non-planar shape, a pin, a surface mount contact portion, a solder tail, a blade contact portion, and/or the like.

In alternative embodiments, at least a portion of the intermediate lead segment 58 of one or more leads 54 may be removed such that the intermediate lead segment 58 of such a lead(s) 54 does not connect the mating and mounting contacts 42 and 56, respectively, of the lead(s) 54. In such an embodiment wherein at least a portion of one or more of the intermediate lead segments 58 is removed, a commoning member (not shown) may be employed to electrically connect the corresponding mating and mounting contacts 42 and 56, respectively.

Referring again to FIG. 3, the housing 28 of the receptacle connector 14 includes one or more guide members 68 and holds the electrical power contacts 32. Each electrical power contact 32 of the receptacle connector 14 includes a mating end 70 that is configured to engage one or more corresponding electrical power contacts 72 (FIGS. 8-11) of the header connector 12 (FIGS. 1, 2, 8, 10, and 11). Each electrical power contact 32 is also configured to be electrically connected to the circuit board 18 when the receptacle connector 14 is mounted thereon. When engaged with the electrical power contacts 72 of the header connector 12, the electrical power contacts 32 and 72 create an electrical power connection between the connectors 12 and 14, and thereby between the circuit boards 16 and 18 (FIGS. 1 and 2). As will be described below, the electrical power contacts 32 are integrated with the guide members 68.

Figure 5:
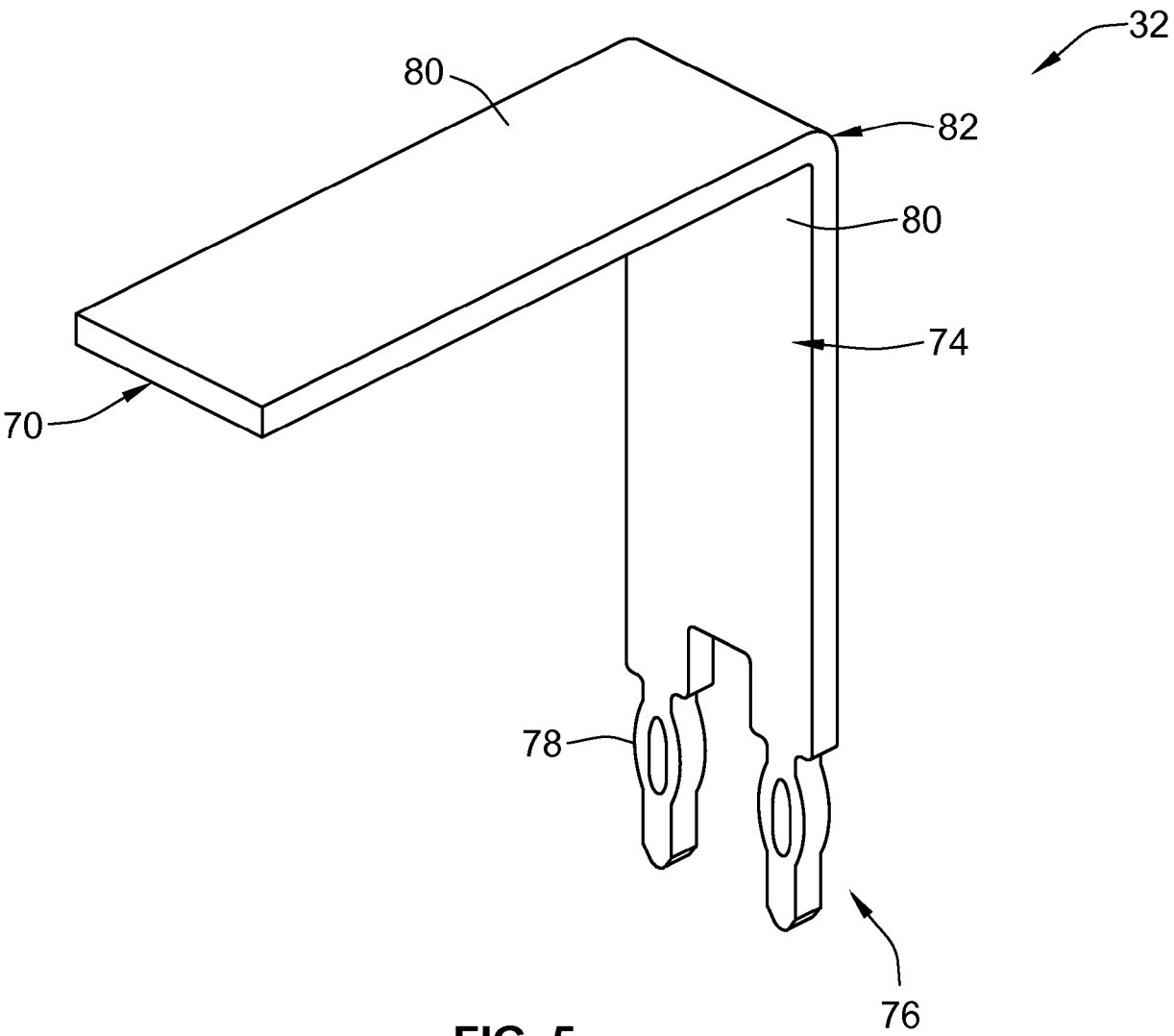
FIG. 5 is a perspective view of an exemplary embodiment of an electrical power contact of the receptacle connector shown in FIGS. 1-3.

FIG. 5 is a perspective view of an exemplary embodiment of one of the electrical power contacts 32. The electrical power contact 32 includes an electrically conductive body 74 that extends from a mounting end 76 to the mating end 70. The mating end 70 is configured to engage the corresponding electrical power contact 72 (FIGS. 8-11) of the header connector 12 (FIGS. 1, 2, 8, 10, and 11). In the exemplary embodiment, the mating end 70 of the electrical power contact 32 is a plug contact having a generally planar and rectangular shape, sometimes referred to as a "blade". However, the mating end 70 of each of the electrical power contacts 32 may include any type of contact portion and may include any shape, such as, but not limited to, a receptacle contact portion, a forked contact portion, a spring contact portion, a non-planar shape, an eye-of-the needle shape, a pin, and/or the like.

The mounting end 76 of the electrical power contact 32 is configured to engage the circuit board 18 (FIGS. 1 and 2) to electrically connect the electrical power contact 32 to the circuit board 18. In the exemplary embodiment, the mounting end 76 of the electrical power contact 32 includes two eye-of-the needle contact portions 78. However, the mounting end 76 of each of the electrical power contacts 32 may include any type of contact portion and may include any shape, such as, but not limited to, a receptacle contact portion, a forked contact portion, a spring contact portion, a non-planar shape, a pin, a surface mount contact portion, a solder tail, a blade contact portion, and/or the like. Although the mounting end 76 of the electrical power contact 32 includes two eye-of-the needle contact portions 78, the mounting end 76 of each electrical power contact 32 may include any number of eye-of-the needle contact portions 78.

The body 74 of the electrical power contact 32 includes an intermediate segment 80 that extends from the mounting end 76 to the mating end 70. In the exemplary embodiment, the intermediate segment 80 includes a bend 82. The bend 82 may have any angle. Moreover, the intermediate segment 80 may include any number of bends 82, each of which my have any angle. In the exemplary embodiment, the bend 82 is approximately 90° such that the mating end 70 extends approximately perpendicular to the mounting end 76. However, the mating end 70 of each of the electrical power contacts 32 may extend at any other angle relative to the mounting end 76 thereof, such as, but not limited to approximately parallel.

Figure 6:
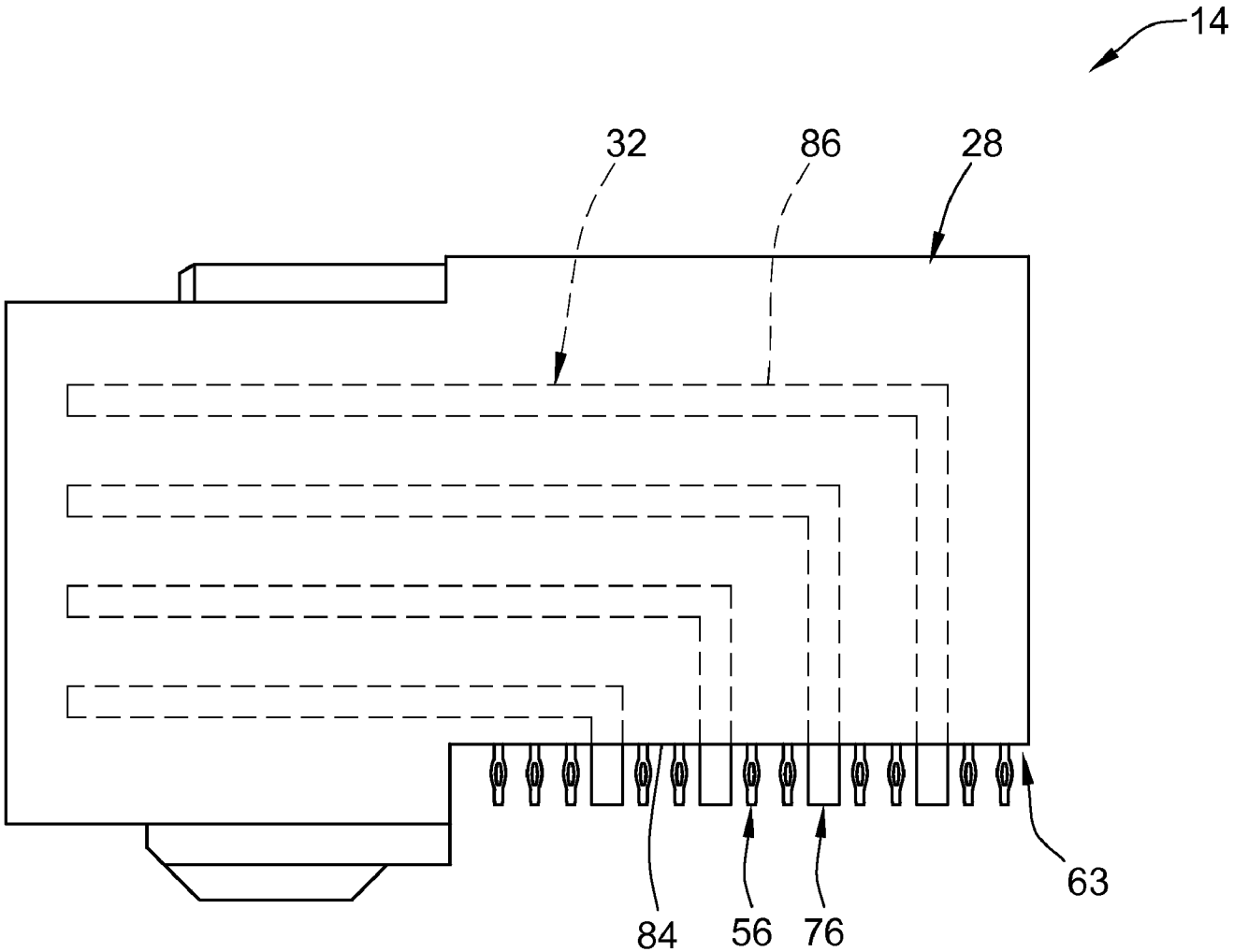
FIG. 6 is a side elevational view of the receptacle connector shown in FIGS. 1-3.

FIG. 6 is a side elevational view of the receptacle connector 14. The receptacle connector 14 includes the mounting face 63, which is defined by the mounting edges 62 (FIG. 4) of the contact modules 30 (FIGS. 3 and 4) and a mounting surface 84 of the housing 28. Each electrical power contact 32 is optionally held within a corresponding internal channel 86 of the housing 28 of the receptacle connector 14. The mounting end 76 of each electrical power contact 32 extends from the mounting surface 84 of the housing 28, and thus from the mounting face 63, for engagement and electrical connection with the circuit board 18 (FIGS. 1 and 2). Some of the mounting contacts 56 of the leads 54 (FIG. 4) of one of the contact modules 30 are also visible in FIG. 6. In the exemplary embodiment, the mounting face 63 extends approximately perpendicular to the mating face 38 (FIG. 3) of the housing 28 such that the mating face 38 extends approximately perpendicular to the circuit board 18. Alternatively, the mounting face 63 may extend at any other angle relative to the mating face 38. The mating face 38 may extend at any other angle relative to the circuit board 18.

Figure 7:
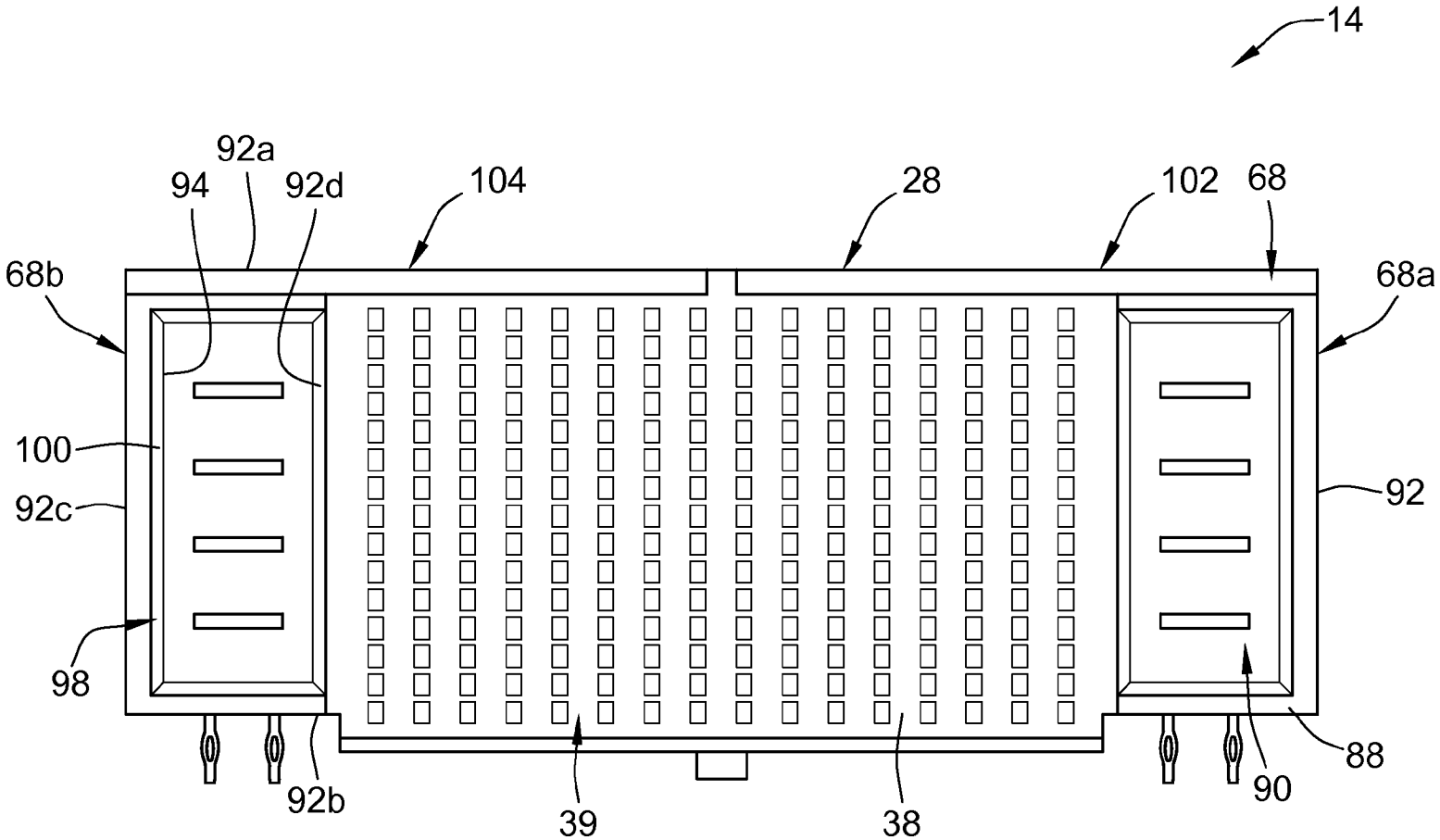
FIG. 7 is a front elevational view of the receptacle connector shown in FIGS. 1-3 and 6.

FIG. 7 is a front elevational view of the receptacle connector 14. Referring now to FIGS. 3 and 7, each guide member 68 includes a front face 88 and a receptacle 90 extending through the front face 88. In the exemplary embodiment, the front face 88 extends approximately parallel to the mating face 38 of the housing 28. However, the front face 88 may extend at any other angle relative to the mating face 38. The receptacle 90 is defined by one or more guide walls 92. Specifically, the receptacle 90 is defined by an interior surface 94 of each of the guide walls 92. The receptacle 90 is configured to receive a corresponding guide member 96 (FIGS. 8 and 11) of the header connector 12 (FIGS. 1, 2, 8, 10, and 11) therein to facilitate aligning the connectors 12 and 14 together during mating thereof.

In the exemplary embodiment, the receptacle 90 of each guide member 68 is defined by four guide walls 92, such that the receptacle 90 has a rectangular shape. Specifically, the guide walls 92 include opposite upper and lower guide walls 92*a* and 92*b*, respectively, and opposite side guide walls 92*c* and 92*d*. The side guide walls 92*c* and 92*d* connect the respective upper and lower guide walls 92*a* and 92*b* together. In other words, the side guide walls 92*c* and 92*d* intersect the upper guide wall 92*a* and the lower guide wall 92*b*. The mating ends 70 of each of the electrical power contacts 32 extend within the receptacle 90 of a corresponding one of the guide members 68. Each of the upper, lower, and side guide walls 92*a*, 92*b*, 92*c*, and 92*d*, respectively, extends around a portion of the mating ends 70 of the electrical power contacts 32. In the exemplary embodiment, the guide walls 92*a*, 92*b*, 92*c*, and 92*d* combine to completely surround the mating ends 70 of the electrical power contacts 32. Alternatively, the guide walls 92*a*, 92*b*, 92*c*, and 92*d* surround only a portion of the mating ends 70 of the electrical power contacts 32. Although the mating ends 70 of four electrical power contacts 32 extend within the receptacle 90 of each guide member 68, each receptacle 90 may hold any number of mating ends 70 of any number of electrical power contacts 32.

The interior surface 94 of one or more of the guide walls 92 includes a guide feature 98 that cooperates with a corresponding one of the guide members 96 of the header connector 12. In the exemplary embodiment, each of the guide features 98 is a slope 100 that extends from the front face 88 into the receptacle 90. The slopes 100 facilitate guiding reception of the corresponding guide member 96 of the header connector 12 into the receptacle 90. In addition or alternative to the slopes 100, each guide wall 92 may include any other type of guide feature that cooperates with the corresponding guide member 96 of the header connector 12, such as, but not limited to, an extension, a recess, a groove, a slot, an arm, a tab, a protrusion, and/or the like. Although the interior surface 94 of each of the guide walls 92 is shown herein as including a guide feature 98, any number of the guide walls 92 may include a guide feature 98. Each guide wall 92 may include any number of guide features 98.

In the exemplary embodiment, the receptacle connector 14 includes two guide members 68 having the signal contact area 39 extending therebetween. Specifically, the signal contact area 39 extends a length from an end 102 to an opposite end 104. One of the guide members 68*a* extends proximate the end 102 of the signal contact area 39, while the other guide member 68*b* extends proximate the end 104. In some alternative embodiments, one or more of the guide members 68 may extend along a different location on the housing 28. Although two are shown, the receptacle connector 14 may include any number of the guide members 68.

Although four are shown, the receptacle 90 of each guide member 68 may alternatively be defined by any other number of guide walls 92 that surround the mating ends 70 of the electrical power contacts 32. Moreover, in addition or alternative to the rectangular shape, the receptacle 90 may include any other shape (such as, but not limited to, circular, oval shaped, triangular, hexagonal, and/or the like) for receiving a guide member 96 that includes any shape.

Figure 8:
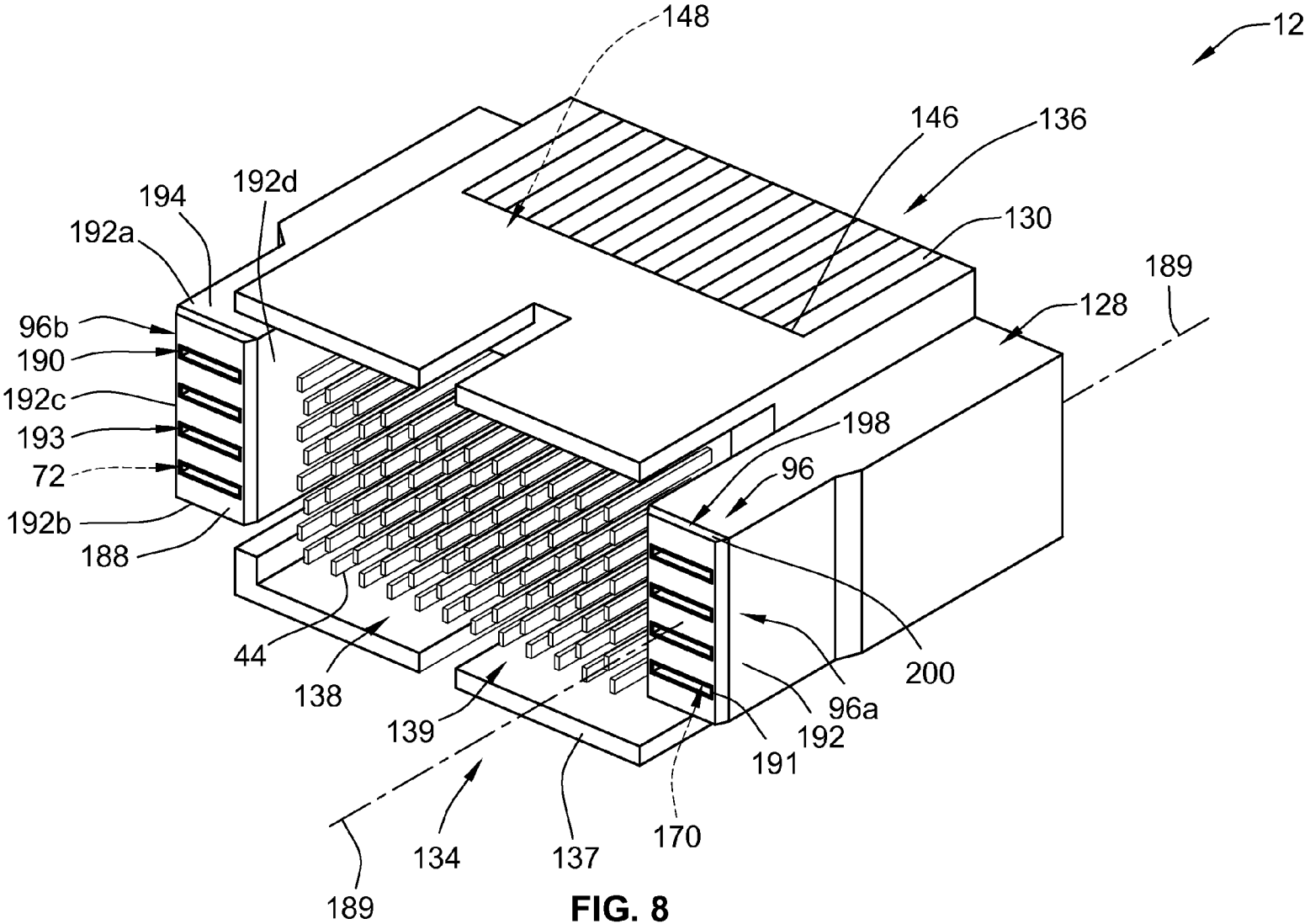
FIG. 8 is a perspective view of an exemplary embodiment of the header connector of the electrical connector system shown in FIGS. 1 and 2.

FIG. 8 is a perspective view of the header connector 12. The header connector 12 includes a housing 128, a plurality of contact modules 130 held by the housing 128, and a plurality of electrical power contacts 72 held by the housing 128. The housing 128 extends from a front end 134 to a rear end 136. The front end 134 of the housing 128 includes a mating interface 138. Mating contacts 44 of the contact modules 130 are arranged in a signal contact array 139 along the mating interface 138. The mating contacts 44 are arranged in a pattern that complements a pattern of the mating contacts 42 (FIG. 4) of the receptacle connector 14 (FIGS. 1-3, 6, and 7). The contact modules 130 are received in the housing 128 from the rear end 136 of the housing 128. Specifically, the housing 128 defines a chamber 146 that receives a forward end 148 of each of the contact modules 130. While sixteen contact modules 130 are shown, the header connector 12 may include any number of the contact modules 130. In addition to the mating contacts 44, each contact module 130 includes a plurality of mounting contacts 156 (FIG. 10) for electrically connecting the header connector 12 to the circuit board 16 (FIGS. 1 and 2). The contact modules 130 are substantially similar to the contact modules 30 (FIGS. 3 and 4) of the receptacle connector 14 and therefore will not be described in more detail herein. One or more of the mating contacts 44 may be referred to herein as an "electrical signal contact". The housing 128 may be referred to herein as a "mating housing".

Each mating contact 44 may include any type of contact portion and may include any shape, such as, but not limited to, a receptacle contact portion, a forked contact portion, a spring contact portion, a non-planar shape, an eye-of-the needle shape, a pin, and/or the like. In the exemplary embodiment, the mounting contacts 156 include eye-of-the needle contact portions. However, each mounting contact 156 may include any type of contact portion and may include any shape, such as, but not limited to, a receptacle contact portion, a forked contact portion, a spring contact portion, a non-planar shape, a pin, a surface mount contact portion, a solder tail, a blade contact portion, and/or the like.

The housing 128 of the header connector 12 includes one or more of the guide members 96 and holds the electrical power contacts 72. Each electrical power contact 72 of the header connector 12 includes a mating end 170 that is configured to engage one or more of the corresponding electrical power contacts 32 (FIGS. 3 and 5-7) of the receptacle connector 14. Each electrical power contact 72 is also configured to be electrically connected to the circuit board 16 when the header connector 12 is mounted thereon. When engaged with the electrical power contacts 32 of the receptacle connector 14, the electrical power contacts 32 and 72 create an electrical power connection between the connectors 12 and 14, and thereby between the circuit boards 16 and 18. As will be described below, the electrical power contacts 72 are integrated with the guide members 96.

Figure 9:
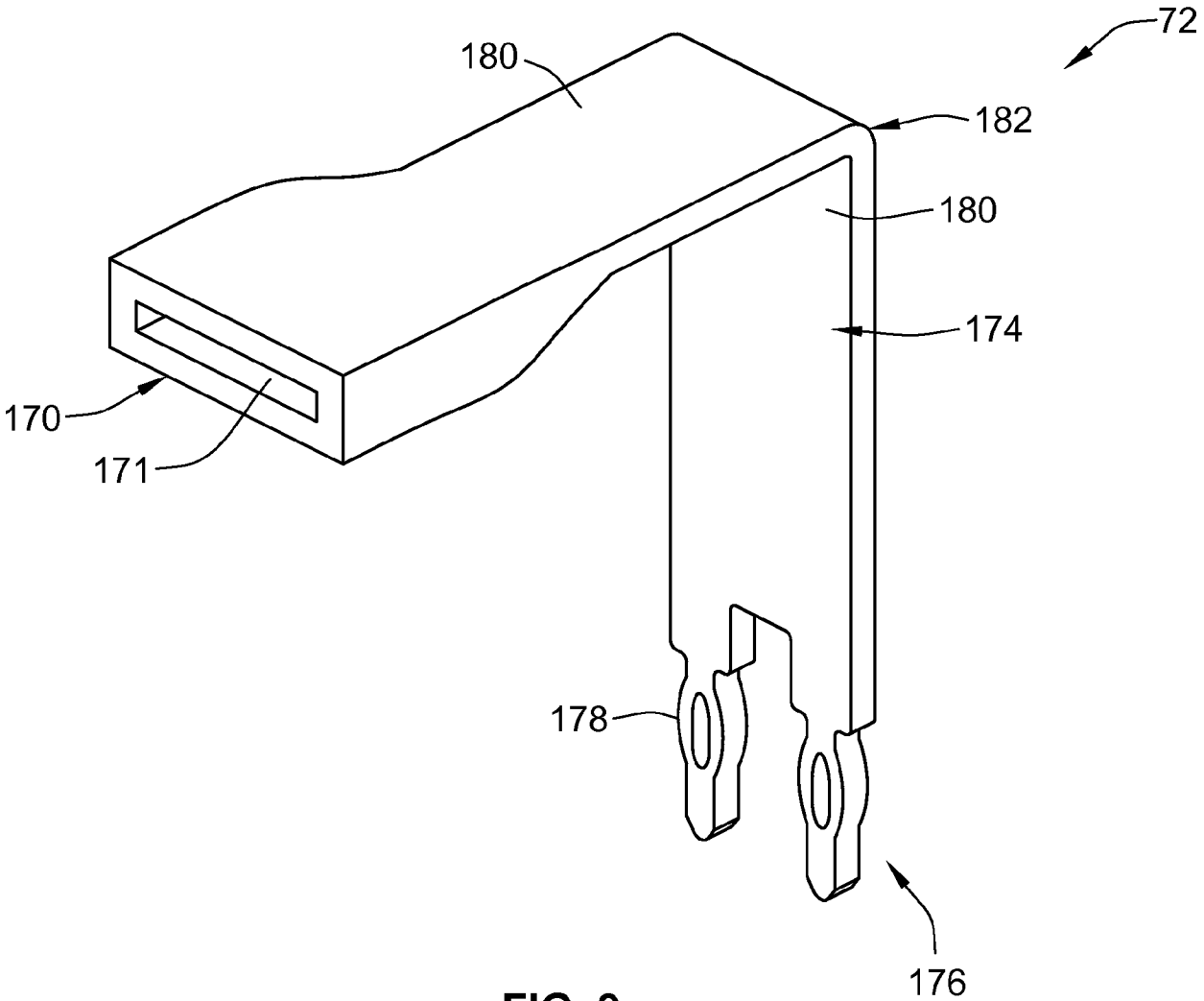
FIG. 9 is a perspective view of an exemplary embodiment of an electrical power contact of the header connector shown in FIGS. 1, 2, and 8.

FIG. 9 is a perspective view of an exemplary embodiment of one of the electrical power contacts 72. The electrical power contact 72 includes an electrically conductive body 174 that extends from a mounting end 176 to the mating end 170. The mating end 170 is configured to engage the corresponding electrical power contact 32 (FIGS. 3 and 5-7) of the receptacle connector 14 (FIGS. 1-3, 6, and 7). In the exemplary embodiment, the mating end 170 of the electrical power contact 72 is a receptacle contact having a receptacle 171 that receives the mating end 70 (FIGS. 3, 5, and 7) of one or more corresponding electrical power contacts 32 therein. However, the mating end 170 of each of the electrical power contacts 72 may include any type of contact portion and may include any shape, such as, but not limited to, a plug contact portion, a forked contact portion, a spring contact portion, a non-planar shape, an eye-of-the needle shape, a pin, a blade, and/or the like.

The mounting end 176 of the electrical power contact 72 is configured to engage the circuit board 16 (FIGS. 1 and 2) to electrically connect the electrical power contact 72 to the circuit board 16. In the exemplary embodiment, the mounting end 176 of the electrical power contact 72 includes two eye-of-the needle contact portions 178. However, the mounting end 176 of each of the electrical power contacts 72 may include any type of contact portion and may include any shape, such as, but not limited to, a receptacle contact portion, a forked contact portion, a spring contact portion, a non-planar shape, a pin, a surface mount contact portion, a solder tail, a blade contact portion, and/or the like. Although the mounting end 176 of the electrical power contact 72 includes two eye-of-the needle contact portions 178, the mounting end 176 of each electrical power contact 72 may include any number of eye-of-the needle contact portions 178.

The body 174 of the electrical power contact 72 includes an intermediate segment 180 that extends from the mounting end 176 to the mating end 170. In the exemplary embodiment, the intermediate segment 180 includes a bend 182. The bend 182 may have any angle. Moreover, the intermediate segment 180 may include any number of bends 182, each which my have any angle. In the exemplary embodiment, the bend 182 is approximately 90° such that the mating end 170 extends approximately perpendicular to the mounting end 176. However, the mating end 170 of each of the electrical power contacts 72 may extend at any other angle relative to the mounting end 176 thereof, such as, but not limited to approximately parallel.

Figure 10:
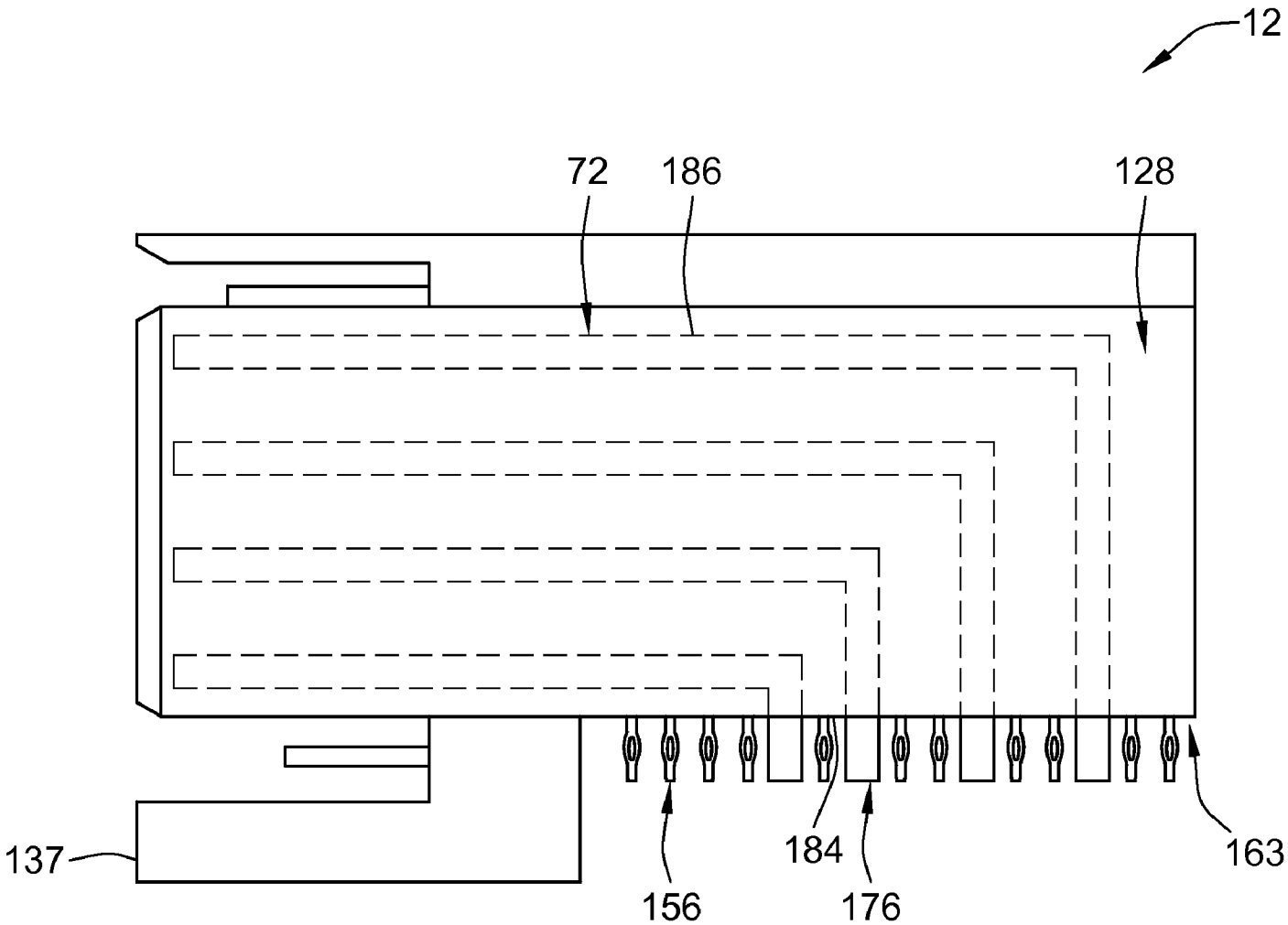
FIG. 10 is a side elevational view of the header connector shown in FIGS. 1, 2, and 8.

FIG. 10 is a side elevational view of the header connector 12. The header connector 12 includes a mounting face 163, which is defined by mounting edges (not shown) of the contact modules 130 (FIG. 8) and a mounting surface 184 of the housing 128. Each electrical power contact 72 is optionally held within a corresponding internal channel 186 of the housing 128 of the header connector 12. The mounting end 176 of each electrical power contact 72 extends from the mounting surface 184 of the housing 128, and thus from the mounting face 163, for engagement and electrical connection with the circuit board 16 (FIGS. 1 and 2). Some of the mounting contacts 156 of one of the contact modules 130 are also visible in FIG. 10. In the exemplary embodiment, the mounting face 163 extends approximately perpendicular to a front face 137 of the housing 128 such that the front face 137 extends approximately perpendicular to the circuit board 16. Alternatively, the mounting face 163 may extend at any other angle relative to the front face 137. The front face 137 may extend at any other angle relative to the circuit board 16.

Figure 11:
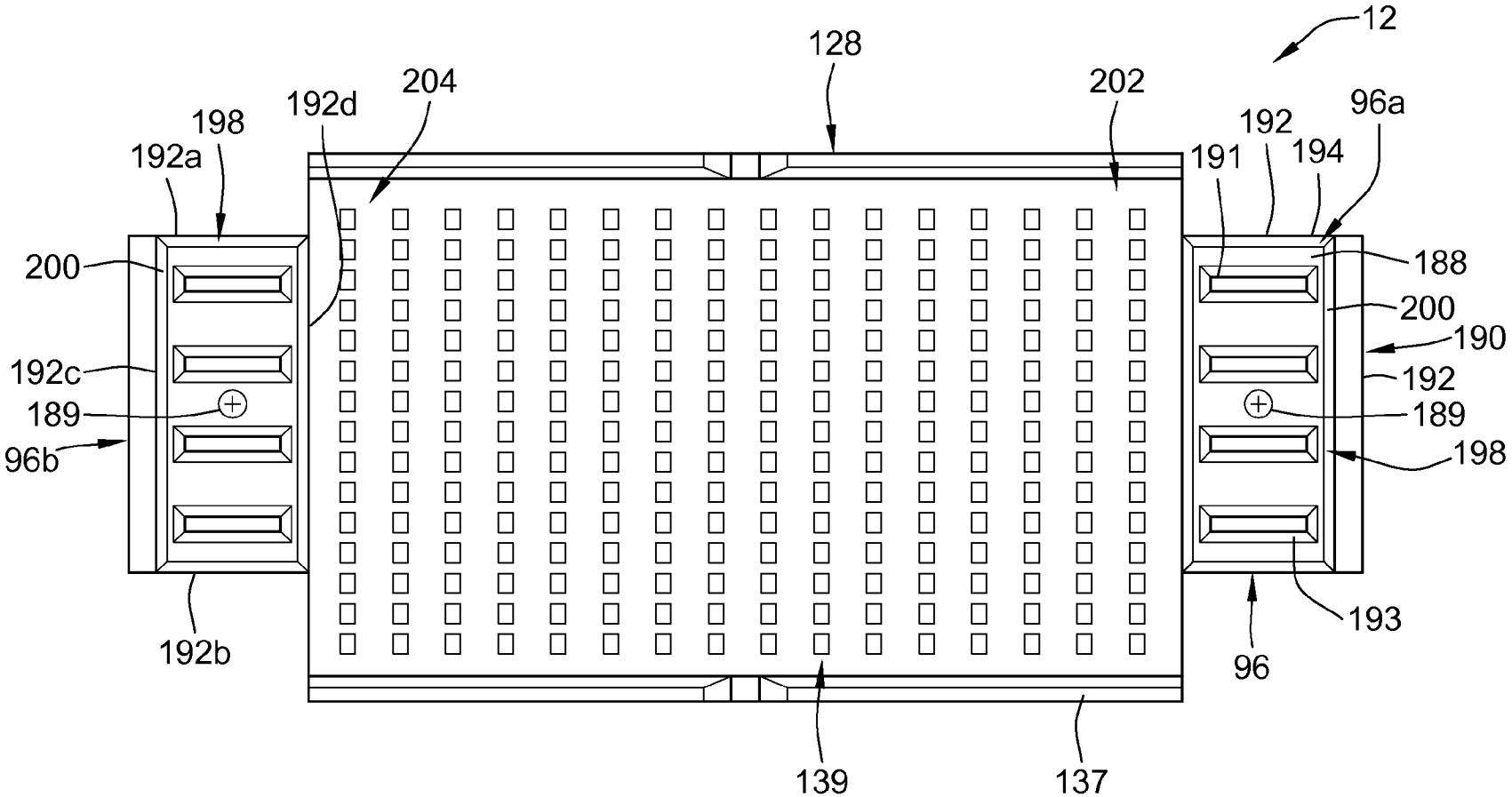
FIG. 11 is a front elevational view of the header connector shown in FIGS. 1, 2, 8, and 10.

FIG. 11 is a front elevational view of the header connector 12. Referring now to FIGS. 8 and 11, each guide member 96 includes a front face 188 and a plug 190. In the exemplary embodiment, the front face 188 extends approximately parallel to the front face 137 of the housing 128. However, the front face 188 may extend at any other angle relative to the front face 137. The plug 190 is defined by one or more guide walls 192. Specifically, the plug 190 is defined by an exterior surface 194 of each of the guide walls 192. The plug 190 is configured to be received within the receptacle 90 of a corresponding one of the guide members 68 (FIGS. 3 and 7) of the receptacle connector 14 (FIGS. 1-3, 6, and 7) therein to facilitate aligning the connectors 12 and 14 together during mating thereof.

In the exemplary embodiment, the plug 190 of each guide member 96 is defined by four guide walls 192, such that the plug 190 has a rectangular shape. Specifically, the guide walls 192 include opposite upper and lower guide walls 192*a* and 192*b*, respectively, and opposite side guide walls 192*c* and 192*d*. The side guide walls 192*c* and 192*d* connect the respective upper and lower guide walls 192*a* and 192*b* together. In other words, the side guide walls 192*c* and 192*d* intersect the upper guide wall 192*a* and the lower guide wall 192*b*.

Each guide member 96 extends a length along a longitudinal axis 189. Each guide member 96 includes one or more individual contact channels 191 extending therein through the front face 188 of the guide member 96. The contact channels 191 fluidly communicate with the optional channels 186 (FIG. 10). The mating ends 170 of the electrical power contacts 72 extend within corresponding ones of the contact channels 191. In the exemplary embodiment, the contact channels 191 are spaced apart from each other along a height of the corresponding guide member 96. Moreover, in the exemplary embodiment a length that each of the contact channels 191 extends into the corresponding guide member 96 is approximately parallel to the longitudinal axis 189 of the guide member 96. Alternatively, the length of one or more of the contact channels 191 extends at any other angle relative to the longitudinal axis 189 of the corresponding guide member 96. Each guide member 96 may include any number of the contact channels 191. Moreover, each contact channel 191 may hold any number of the mating ends 170 of any number of the electrical power contacts 72.

The exterior surface 194 of one or more of the guide walls 192 includes a guide feature 198 that cooperates with a corresponding one of the guide features 98 of the corresponding guide member 68 of the receptacle connector 14. In the exemplary embodiment, each of the guide features 198 is a slope 200 that extends from the front face 188 along the exterior surface 194. The slopes 200 facilitate guiding reception of the guide member 96 within the corresponding receptacle 90 of the receptacle connector 14. In addition or alternative to the slopes 200, each guide wall 192 may include any other type of guide feature that cooperates with the corresponding guide feature 98 of the corresponding guide member 68 of the receptacle connector 14, such as, but not limited to, an extension, a recess, a groove, a slot, an arm, a tab, a protrusion, and/or the like. Although the exterior surface 194 of each of the guide walls 192 is shown herein as including a guide feature 198, any number of the guide walls 192 may include a guide feature 198. Each guide wall 192 may include any number of guide features 198.

One or more of the contact channels 191 optionally includes a guide element 193. In the exemplary embodiment, each of the guide elements 193 is a slope. The slopes facilitate guiding reception of the mating ends 70 of the electrical power contacts 32 within the corresponding contact channel 191. In addition or alternative to the slopes, each contact channel 191 may include any other type of guide element, such as, but not limited to, an extension, a recess, a groove, a slot, an arm, a tab, a protrusion, and/or the like. Any number of the contact channels 191 may include a guide element 193. Each contact channel 191 may include any number of guide elements 193.

In the exemplary embodiment, the header connector 12 includes two guide members 96 having the signal contact array 139 extending therebetween. Specifically, the signal contact array 139 extends a length from an end 202 to an opposite end 204. One of the guide members 96*a* extends proximate the end 202 of the signal contact array 139, while the other guide member 96*b* extends proximate the end 204. In some alternative embodiments, one or more of the guide members 96 may extend along a different location on the housing 128. Although two are shown, the header connector 12 may include any number of the guide members 96.

Although four are shown, the plug 190 of each guide member 96 may alternatively be defined by any other number of guide walls 192. Moreover, in addition or alternative to the rectangular shape, the plug 190 may include any other shape (such as, but not limited to, circular, oval shaped, triangular, hexagonal, and/or the like) for being received within a guide member 68 that includes any shape.

In some alternative embodiments, the receptacle connector 14 may include one or more of the guide members 96, and/or the header connector 12 may include one or more of the guide members 68.

The embodiments described and/or illustrated herein may provide an electrical connector having electrical power contacts that are integrated with the guide members.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "upper", "lower", "first", "second", "third," etc. are used merely as labels, and are not intended to impose numerical, orientational, and/or other requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector for mating with a mating connector, said electrical connector comprising:

a single, unitary housing comprising a mating face, a signal contact area, and a guide member, the guide member comprising a receptacle and a guide wall, the guide wall comprising an interior surface that at least partially defines the receptacle, the interior surface comprising a guide feature, the receptacle being configured to receive a plug of a mating housing of the mating connector therein;

electrical signal contacts held by the housing within the signal contact area, wherein the receptacle of the guide member does not fluidly communicate with an opening within which at least one of the signal contacts extends; and an electrical power contact comprising a mating end held within the receptacle of the guide member, the guide wall of the guide member extending at least partially around the mating end of the electrical power contact, wherein the mating end of the electrical power contact comprises a planar blade.

2. The electrical connector according to claim 1, wherein the guide wall comprises guide walls, the mating face defines the signal contact area, and the guide member is adjacent the mating face, the receptacle of the guide member having a rectangular shape and being bounded by the guide walls such that the interior surfaces of the guide walls define the rectangular shape, the mating end of the electrical power contact being surrounded by the interior surfaces of the guide walls, wherein the guide walls are devoid of any opening which disrupts the rectangular shape of the receptacle.

3. The electrical connector according to claim 1, wherein the guide member comprises a pair of guide members, the signal contact area extending between the pair of guide members.

4. The electrical connector according to claim 1, further comprising a contact module held by the housing, the contact module comprising the electrical signal contact.

5. The electrical connector according to claim 1, wherein the guide feature of the guide wall comprises a slope.

6. The electrical connector according to claim 1, wherein the guide member comprises a front face, the guide feature comprising a slope extending from the front face into the receptacle.

7. The electrical connector according to claim 1, wherein the electrical power contact comprises electrical power contacts, the mating ends of the electrical power contacts being held within the receptacle of the guide member.

8. The electrical connector according to claim 1, wherein the housing comprises a mounting face configured to be mounted on a circuit board, the electrical power contact comprising a mounting end extending from the mounting face of the housing.

9. An electrical connector for mating with a mating connector, said electrical connector comprising:

a single, unitary housing comprising a mating interface and a guide member, the guide member comprising a plug configured to be received by a mating housing of the mating connector, the guide member comprising an exterior surface that at least partially defines the plug, the guide member comprising a guide feature, the guide member comprising individual contact channels extending therein;

electrical signal contacts held by the housing in a signal contact array along the mating interface, wherein the exterior surface of the guide member defines a boundary of an opening within which at least one of the signal contacts extends; and electrical power contacts held by the housing, the electrical power contacts comprising mating ends that extend within corresponding ones of the individual contact channels of the guide member for receiving with corresponding contacts of the mating connector wherein at least one of the electrical power contacts comprises a receptacle.

10. The electrical connector according to claim 9, wherein the guide member extends a height, the individual contact channels being spaced apart from each other along the height of the guide member.

11. The electrical connector according to claim 9, wherein at least one of the individual contact channels comprises a guide element.

12. The electrical connector according to claim 9, wherein the guide member extends a length along a longitudinal axis, the individual contact channels extending lengths that are approximately parallel to the longitudinal axis.

13. The electrical connector according to claim 9, wherein the guide member comprises a front face, the individual contact channels extending through the front face of the guide member.

14. The electrical connector according to claim 9, wherein the guide member comprises a pair of guide members, the signal contact array extending between the pair of guide members.

15. The electrical connector according to claim 9, wherein the guide feature of the guide member comprises a slope.

16. The electrical connector according to claim 9, further comprising a plurality of contact modules held by the housing, the contact modules comprising the electrical signal contacts.

17. The electrical connector according to claim 9, wherein the plug of the guide member has a rectangular shape defined by guide walls each of the guide walls has an exterior surface such that the exterior surfaces of the guide walls define the rectangular shape, the guide walls being devoid of any extension which disrupts the rectangular shape of the plug.

18. An electrical connector for mating with a mating connector, said electrical connector comprising:

a housing comprising a mating face, a signal contact area, and a guide member, the guide member comprising a receptacle and a guide wall, the receptacle being separated from the signal contact area by the guide wall, the guide wall comprising an interior surface that at least partially defines the receptacle, the interior surface comprising a guide feature, the receptacle being configured to receive a plug of a mating housing of the mating connector therein;

a plurality of contact modules held by the housing, the contact modules comprising electrical signal contacts that are held within the signal contact area of the housing; and electrical power contacts comprising mating ends held within the receptacle of the guide member, the guide wall of the guide member extending at least partially around the mating ends of the electrical power contacts wherein at least one of the mating ends of the electrical power contacts comprises a planar blade.

* * * * *